US006001237A

United States Patent [19]

Mansour et al.

[11] Patent Number: 6,001,237

[45] Date of Patent: Dec. 14, 1999

[54] ELECTROCHEMICAL FABRICATION OF CAPACITORS

[75] Inventors: Azzam N. Mansour, Fairfax Sta., Va.; Carlos A. Melendres, Lemont, Ill.

[73] Assignee: The United States of America as represented by the Secretary of the Navy, Washington, D.C.

[21] Appl. No.: 08/982,892

[22] Filed: Dec. 2, 1997

[51] Int. Cl.[6] ..... C25D 9/00

[52] U.S. Cl. ..... 205/333; 205/82; 204/242

[58] Field of Search ..... 205/333, 335, 205/81, 84, 159; 204/279, 242, 275, 244 R

[56] References Cited

U.S. PATENT DOCUMENTS 3,767,541 10/1973 Curtis ..... 204/56 R
4,659,437 4/1987 Shiba et al. ..... 204/28
4,808,277 2/1989 Sluyters ..... 204/28
5,141,617 8/1992 Nagy et al. ..... 204/231
5,368,716 11/1994 Kikuta ..... 205/84

*Primary Examiner*—Kathryn Gorgos
*Assistant Examiner*—Erica Smith-Hicks
*Attorney, Agent, or Firm*—John Forrest; Jacob Shuster

[57] ABSTRACT

A film of nickel oxide is anodically deposited on a graphite sheet held in position on an electrochemical cell during application of a positive electrode voltage to the graphite sheet while exposed to an electrolytic nickel oxide solution within a volumetrically variable chamber of the cell. An angularly orientated x-ray beam is admitted into the cell for transmission through the deposited nickel oxide film in order to obtain structural information while the film is subject to electrochemical and in-situ x-ray spectroscopy from which optimum film thickness, may be determined by comparative analysis for capacitor fabrication purposes.

6 Claims, 2 Drawing Sheets

ELECTROCHEMICAL FABRICATION OF CAPACITORS

The present invention relates in general to the selection and testing of materials in association with the production of ultracapacitors or the like. Rights to this invention reside in the United States Government as represented by the Secretary of the Navy and the United States Department of Energy pursuant to Contract No. W-31-109-ENG-38 with the University of Chicago representing Argonne National Laboratory.

BACKGROUND OF THE INVENTION

Electrochemical methods for making ultracapacitor electrodes are generally well known but vary considerably with respect to temperature processing conditions, deposit solution formation, deposition timing and other complex steps associated therewith. It is a common practice in such methods to coat a metal substrate with active materials followed by heat treatment. Such practices are relatively costly in terms of time and effort involved. It is therefore an important object of the present invention to enable more efficient and less costly electrochemical fabrication of high storage capacitors in a wide variety of installations including commercial use in electric automobiles and in torpedo propulsion systems for military purposes, involving multivalent materials prepared by anodic deposition on a substrate.

SUMMARY OF THE INVENTION

Pursuant to the present invention, an oxide of a metal as capacitive material in solution with an electrolyte solvent is applied by anodic deposition to a high surface area carbon substrate such as graphite for use in a capacitor. The metal is selected from a group including nickel, manganese, other transition metals and ruthenium found suitable for electrochemical capacitors. The anodic deposition is performed within an electrochemical cell through which the metal oxide is readily deposited as a coating film on the substrate of a graphite sheet electrode and then tested in-situ within the cell by an x-ray absorption procedure in order to variably control the thickness of the coating film by selection of the oxide solution composition, its temperature by heating of the electrolyte solvent and by selecting the magnitude of a positive electrical potential applied to the graphite electrode and anodic deposition timing. The electrochemical cell thereby enables both fluorescent and transmission measurements to be carried out simultaneously for continuous calibration of x-ray energy through which x-ray absorption testing and measurement of the metal oxide is performed. By varying the internal gap of the cell and venting of electrolysis generated gas resulting from reactions which occur during deposit of the metal oxide film, accurate measurements may be carried out on the electrodeposited metal oxide film.

In accordance with one embodiment of the invention, nickel selected as the oxide metal in with a $NiSO_4$ electrolyte solution is used for anodic deposition within the electrochemical cell onto a graphite substrate at a temperature of about 25° C. and under a low voltage to produce an average valence state between +2 and +4 for the deposited film layer. Such electrodeposited nickel oxide film layer also has good adherence to the graphite substrate so as to be particularly useful in the fabrication of ultracapacitors.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawings wherein.

DETAILED DESCRIPTION OF PREFERRED EMBODIMENT

Figure 1:
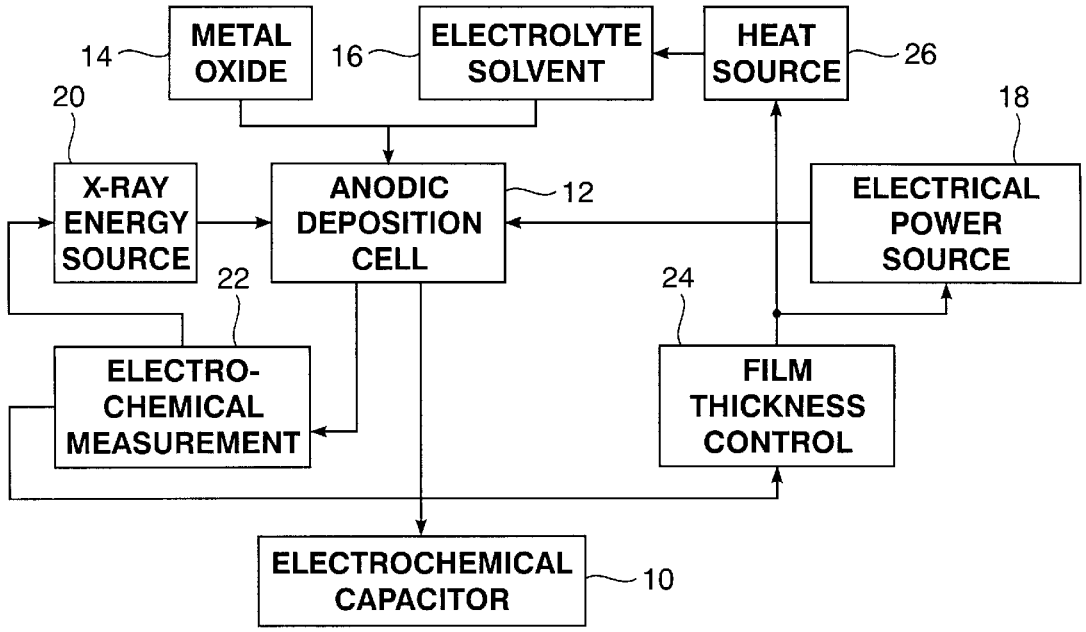
FIG. 1 is a block diagram schematically depicting fabrication of an electrochemical capacitor in accordance with the present invention.
Figure 2:
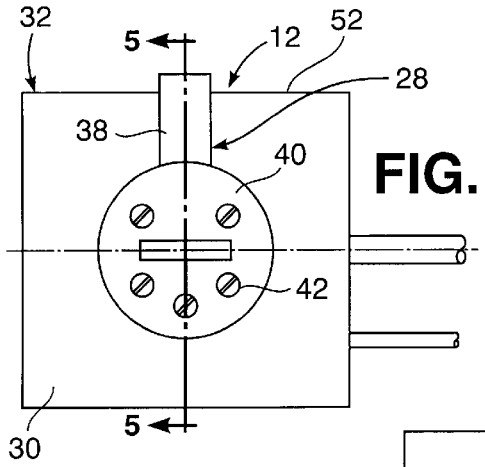
FIGS. 2, 3 and 4 are respectively front, side and top views of the anodic deposition cell schematically depicted in the block diagram of FIG. 1 in an adjusted condition during deposition of a metal oxide coating on a graphite electrode.

Referring now to the drawing in detail, FIG. 1 depicts fabrication of an electrochemical capacitor 10 as a product of anodic deposition within a cell 12 to which a solution of metal oxide 14 and electrolyte solvent 16 is fed for exposure thereto of a high surface area carbon substrate to which an electrical voltage is applied from power source 18 during a measurement stage of operation by a generally known electrochemical measurement procedure 22 following anodic deposition of the metal oxide from a solution of a suitable metal salt onto a limited surface area of the substrate.

The anodic type of deposition performed within cell 12 results in formation of a thin layer of the metal oxide 14 having a film thickness that may be varied through control 24 in accordance with the electrochemical measurements obtained in-situ as a result of the procedure 22. Thus, the control 24 involves variation in the electrical potential applied by power source 18 to the graphite electrode in cell 12 as well as the temperature to which the solvent 16 may be heated by a heat source 26 as also diagrammatically depicted in FIG. 1 and the anodic deposition timing. Selection of the metal salt 14 and composition of the electrolyte solvent 16 forming the metal salt solution fed to the cell 12 is also a factor in determining the optimum thickness of the metal oxide deposited film coating the graphite substrate for fabrication of the capacitor 10. FIGS. 2–6 illustrate the electrochemical cell 12 within which anodic deposition is performed, in accordance with one embodiment found especially suitable by the selection of nickel as the metal of the oxyhydroxide to be deposited on a carbon substrate in the form of graphite sheet electrode 28. Such electrode 28 is removably held assembled on the front face 30 of a generally rectangular shaped body 32 of the cell 12 within which a generally cylindrical chamber 34 is formed as shown in FIGS. 5 and 6. The electrode 28 is closely spaced from the face 30 of the cell body 32 by a rubber gasket 36 while covered below its elongated extension 38 by a circular holder plate 40 from which screws 42 extend into the cell body 32. A positive electrical potential is selectively applied through electrode extension 38 from a voltage source 43 as diagrammatically shown in FIG. 7 to initiate anodic deposition. An opening slot 44 is formed within the electrode holder plate 40 through which entry of an x-ray beam 84 occurs during the x-ray absorption measurement stage of operation following film deposition. The x-ray entry slot 44 is aligned with a slot 46 formed in the rubber spacer gasket 36 through which the x-ray beam enters the opening 48 in the front face wall 30 of the cell body 32. The slot 46 in the spacer 36 dimensionally limits the substrate area on the sheet electrode 28 exposed to the electrolytic solution during anodic deposition. A plurality of capillary passages 50 extend from the top wall face 52 of the cell body into the opening 48, as shown in FIGS. 4 and 5, for venting reaction generated gases during anodic deposition. Such gas venting passages 50 extend at right angles to solution inlet and outlet passages 54 and 56 as shown in FIG. 6. Solution inlet and outlet tubes 58 and 60, respectively aligned with passages 54 and 56, extend from the side wall face 62 of the cell body for circulation of the electrolytic solution into and out of the cell followed by the anodic film deposition and measurement stages of operation.

Figure 3:
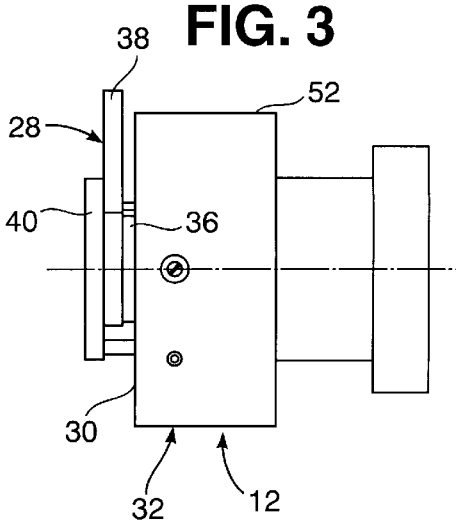
Figure 4:
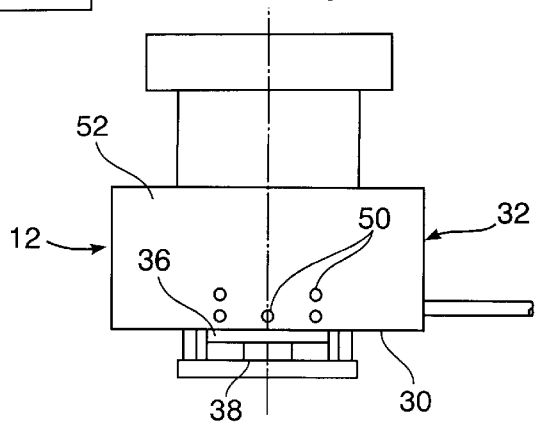
Figure 5:
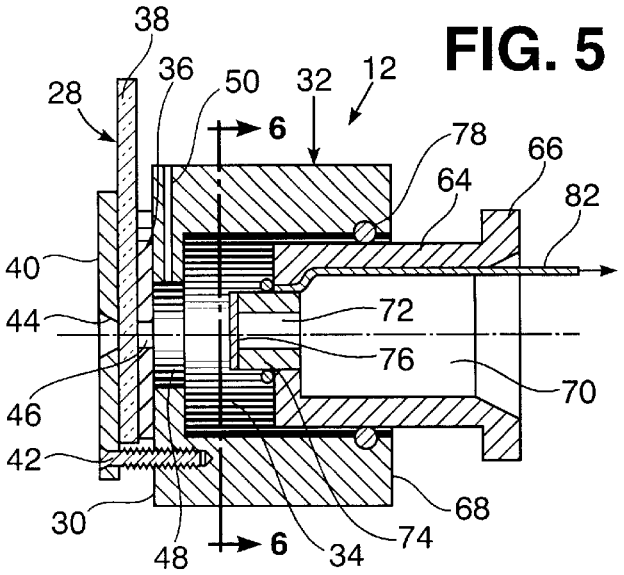
FIG. 5 is a side section view taken substantially through a plane indicated by section line 5—5 in FIG. 2.
Figure 6:
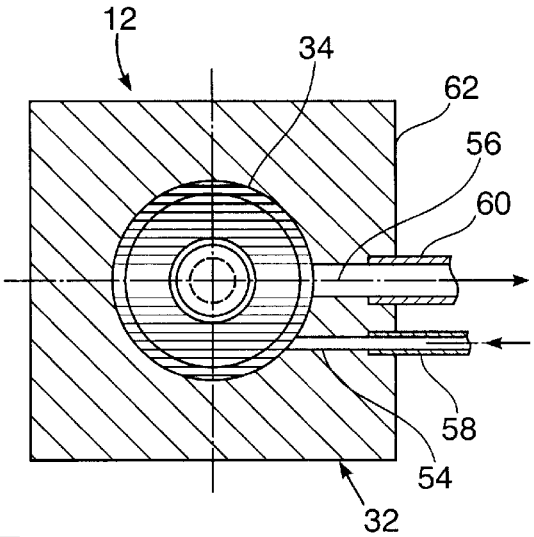
FIG. 6 is a front section view taken substantially through a plane indicated by section line 6—6 in FIG. 5.

Associated with the cell 12 as shown in FIGS. 3, 4 and 5, is an axially displaceable cylindrical member 64 having a circular flange 66 at one axial end spaced from the rear end face of the cell body 32. The cylindrical member 64 encloses a cylindrical passage 70 from which a smaller diameter passage 72 extends through an inlet section 74 of member 64 toward an inner end closed by a Kapton window 76 as shown in FIG. 5. While the window 76 blocks outflow of the electrolytic solution in chamber 34, the x-ray beam is transmitted therethrough during the x-ray absorption measurement stage of operation while the member 64 is in the position shown in FIG. 7 corresponding to a minimized volume of chamber 34 associated with a small axial gap between window 76 and spacer 36 filled with the electrolyte solution. A rubber o-ring 78 held within a recess formed in the cell body 32 in spaced adjacency to its end face 68, is in sliding contact with member 64 to block outflow of the chamber filling solution. Also mounted externally on the inlet section 74 of member 64 is a gold wire counter electrode 80 connected to an electrical lead 82 extending rearwardly out of the end flange 66 of the member 64 for delivery of electrochemical measurement signals.

Figure 7:
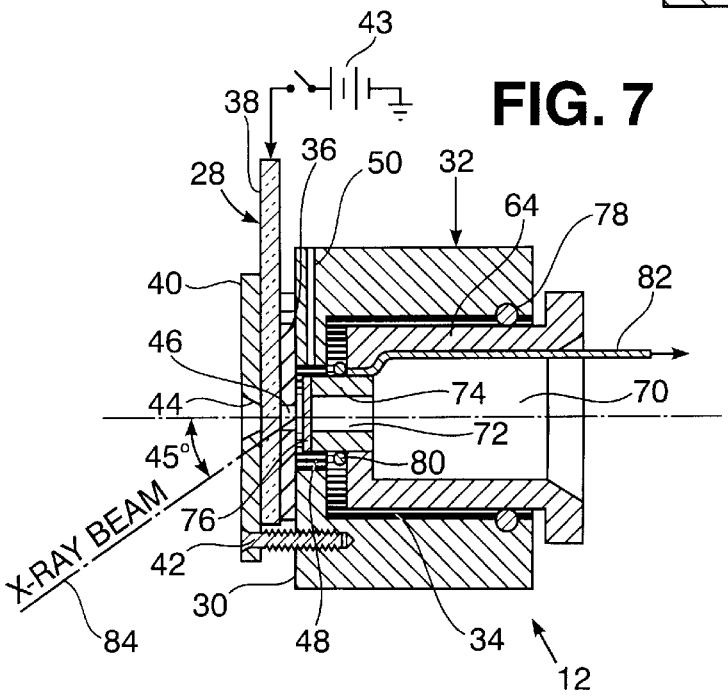
FIG. 7 is a side section view similar to that of FIG. 5 showing the anodic deposition cell in another condition during testing and measurement following deposition of the metal oxide film layer on the graphite electrode.

With continued reference to FIG. 7, the displaceable member 64 of cell 12 in its inner position reduces the solution path length along the cell axis while x-ray absorption spectroscopy is performed during electrochemical measurement. Toward that end, the x-ray beam 84 is directed into the opening slot 44 in the electrode holder plate 40 at a 45° orientation angle to the axis of the cell 12 at its front face 30 as depicted in FIG. 7. X-ray absorption measurements are thereby made through the counter electrode 80 and electrical lead 82 with respect to a metal oxide film anodically deposited on a limited area of the graphite electrode 38 either during exposure to the electrolytic solution in chamber 34 through slot 46 in the spacer 36 and/or after removal of the solution. Electrochemical equipment already known in the art for obtaining and analyzing such measurements is utilized, including a potentiostat, voltage scan programmer and recorder. In regard to nickel as the oxide metal in the film layer electrodeposited onto the graphite sheet from $NiSO_4$ as the electrolytic solution within cell 12 under a low positive voltage applied to the electrode 38, the measurements revealed the presence of multiple valence states of +2 and +4 for such deposited material and a high capacitance property. Also in view of the ease with which such capacitive material adhesively coats the graphite sheet within cell 12 and its relatively low cost, it is highly useful in ultracapacitor installations.

Obviously, other modifications and variations of the present invention may be possible in light of the foregoing teachings. It is therefore to be understood that within the scope of the appended claims the invention may be practiced otherwise than as specifically described.

What is claimed is:

1. A process for coating a substrate with a capacitive material for use in fabricating a capacitor having said substrate including the steps of: mixing said capacitive material with a solvent to form an electrolytic solution; applying said electrolytic solution to the substrate; applying an electrode voltage to said substrate while exposed to the electrolytic solution for anodic deposition of the capacitive material therefrom onto the substrate as a film coating the substrate: subjecting said capacitive material forming the film coating the substrate to x-ray spectroscopy while performing in-situ electrochemical measurements with respect thereto; analyzing said measurements to determine optimum thickness of the film to be deposited; and varying temperature of the electrolytic solution, deposition timing and electrical potential of the electrode voltage to obtain said optimum thickness for the film deposited on the substrate.

2. The process as defined in claim 1 wherein the selected capacitive material is nickel oxide and the substrate is formed on a graphite sheet.

3. An electrochemical apparatus through which a graphite substrate is coated with a film of metal oxide, comprising: a body enclosing a chamber; displaceable means movably mounted within said body for variation in volume of the chamber; conduit means connected to the body for filling said chamber with an electrolytic solution of the metal oxide; an electrode on which said graphite substrate is formed and to which an electrical potential is applied; means fixedly holding the electrode on the body for exposure of a limited surface on the graphite substrate to the electrolytic solution during deposition of said film under said electrical potential; and means for confining transmission of an externally generated x-ray beam through the film deposited on said limited surface of the graphite substrate within said chamber.

4. The electrochemical apparatus as defined in claim 3 wherein said displaceable means comprises an elongated member slidably movable between positions within the body respectively maximizing and minimizing volume of the chamber; a window mounted on one end of the elongated member inside the chamber through which the x-ray beam is transmitted while blocking outflow of the electrolytic solution; and counter electrode means mounted on the elongated member in spaced adjacency to said window through which electrochemical measurements are made while exposed to the electrolytic solution within the chamber in the position of the elongated member minimizing the volume thereof.

5. Apparatus for fabricating a capacitor by coating of a substrate with a capacitive material, comprising: chamber means within which said capacitive material is received for mixing with solvent to form an electrolytic solution; means for exposure of the substrate to the electrolytic solution formed within the chamber means; means for applying an electrode voltage during a limited interval to said substrate while exposed to the electrolytic solution for deposit of the capacitive material therefrom onto the substrate as a film; means for directing externally generated x-ray energy onto said film for spectrographic absorption of the x-ray energy confined to the film; and means for performing in-situ electrochemical measurements of the film after said absorption of the x-ray energy therein.

6. The apparatus as defined in claim 5, including: control means responsive to said electrochemical measurements for volumetric variation of the chamber means to variably heat the electrolytic solution during said exposure of the substrate thereto; and varying timing of said limited interval of the electrode voltage applied to the substrate.

* * * * *